United States Patent [19]

Murakami et al.

[11] Patent Number: 4,692,750

[45] Date of Patent: Sep. 8, 1987

[54] FIRE ALARM SYSTEM

[75] Inventors: Kazumasa Murakami; Motoharu Terada, both of Kadoma, Japan

[73] Assignee: Matsushita Electric Works, Ltd., Osaka, Japan

[21] Appl. No.: 869,786

[22] Filed: Jun. 2, 1986

[30] Foreign Application Priority Data

Mar. 31, 1986 [JP] Japan ..... 61-74654
Mar. 31, 1986 [JP] Japan ..... 61-74655

[51] Int. Cl.[4] ..... G08B 17/00; G08B 23/00

[52] U.S. Cl. ..... 340/588; 340/587; 340/589; 340/501; 340/506; 340/511; 340/514; 340/628; 340/630; 340/870.17; 250/574

[58] Field of Search ..... 340/588, 587, 589, 500, 340/501, 506, 511, 514, 510, 628, 630, 629, 870.16, 870.17; 250/574, 472.1

[56] References Cited

U.S. PATENT DOCUMENTS 4,489,312 12/1984 Yoshizaki ..... 340/514
4,518,952 5/1985 Tanaka et al. ..... 340/514
4,556,873 12/1985 Yamada et al. ..... 340/630

*Primary Examiner*—Donnie L. Crosland

*Attorney, Agent, or Firm*—Armstrong, Nikaido, Marmelstein & Kubovcik

[57] ABSTRACT

An improved fire alarm system utilizes receiver and fire detecting terminals connected thereto through a signal transmission line comprising two wires. The fire detecting terminal operates on two mode, one being a contact-closure mode of transmitting to the receiver a level signal whether or not a significantly higher fire-indicative quantity is detected, and the other being intelligent mode of transmitting a digital signal indicative of the sensed quantity in the form of a superimposed signal upon the level signal in answer to the instruction from the receiver for precise and convenient analysis thereof in determining fire presence on the side of the receiver. The fire detecting terminal includes a comparator having its own threshold with which the value of the sensed analog quantity is compared for providing the level-shifted signal when the sensed analog quantity has a level higher than the threshold, notifying fire presence independently of the intelligent mode. The threshold level can be selected independently of a criterion utilized in determining first presence based upon the digital signal on the receiver, so that the above two modes can have the same sensitivity against possible fires. Accordingly, the contact-closure mode can well stand for a back-up fire detection without reduction in sensitivity.

11 Claims, 9 Drawing Figures

FIRE ALARM SYSTEM

BACKGROUND OF THE DISCLOSURE

1. Fields of the Invention

The present invention is directed to a fire alarm system, and more particularly to a fire alarm system in which fire detecting terminal means are connected to a common transmission line to a receiver where the information transmitted from the fire detecting terminal means is processed for determination of fire presence.

2. Description of the Prior Art

Such a fire alarm system is already known in the art as disclosed in U.S. Pat. No. 4,556,873 issued on Dec. 3, 1986 and assigned to the same assignee of this application. This patent utilizes intelligent-type smoke detectors connected to a receiver or central unit through a common signal transmission line comprising two wires. The intelligent-type smoke detector includes a basic function of transmitting a binary information of the sensed smoke density to the receiver in answer to the instruction from the receiver for determination of fire presence on the side of the receiver. Additionally included in the smoke detector as a safeguard against possible failure of transmitting the binary information of the smoke density is a back-up function of providing a level-shifted signal to the receiver over the transmission line in the event that the analog value of the sensed smoke density is determined on the side of the detector to be higher than a predetermined threshold value, which occurrence being acknowledged by the receiver as indicating fire presence independently of the above basic function. The idea behind the above fire alarm system is to provide a back-up operation of successfully monitoring the presence or absence of fire even when the binary information of the sensed smoke density fails to be transmitted to the receiver due to unexpected failure of transmitting the binary information of the sensed smoke density. In fact, the level-shifted signal transmission network is less likely to fail than the digital signal transmission network utilizing a more sophisticated hardware like a CPU and thus can well stands for the back-up operation.

For implementation of the above fire detecting system, it is a normal practice to constantly actuate the digital signal transmission network as a main fire detection scheme for more precise and convenient analysis of fire presence in accordance with the differing environmental conditions of locations to be monitored while disabling the level signal transmission network or back-up fire detection scheme, and set the latter network into operation only when the sensed quantity becomes significantly higher above the threshold level so that it can detect fire presence even in case of the failure of the digital signal transmission network. With this methodology, the level signal transmission network is limited to have a less sensitivity against possible fires than the digital signal transmission network, otherwise the back-up scheme would become operative while the main scheme is in operation so as to nullify or detract from the precise analysis of fire presence even the digital transmission scheme is operating correctly, thus unduly reducing the sensitivity against possible fires.

In this sense, the prior art system is not completely satisfactory in providing a true back-up protection retaining a higher sensitivity substantially equal to the main fire detection scheme so long as the level signal transmission network is rendered inoperative unless there detected a higher sensor output than required by the digital signal transmission network in determining fire presence. Therefore, it is mostly desired for providing the true back-up protection of the fire alarm system which includes the level signal transmission network having the same sensitivity as the main fire detection or digital signal transmission network, although they operate on the different modes of fire detection.

SUMMARY OF THE INVENTION

In view of the above insufficiency, the present invention has been achieved to provide an improved fire alarm system with a reliable back-up fire detection scheme. The fire alarm system in accordance with the present invention comprises a receiver in combination with fire detecting terminal means connected thereto through a common signal transmission line comprising two wires. The fire detecting terminal means includes a sensor for sensing a fire-indicative parameter such as a smoke density to be measured and producing an analog signal representative thereof, and a level-signal output section for transmitting a level signal to the receiver. The level-signal output section including level-shifting or switching means connected between the wires of the transmission line so as to cause the level-shifting of the level signal when the sensed parameter has a level higher than a predetermined threshold level. Also included in the fire detecting terminal means are an analog-digital converter for converting the analog output from the sensor into a corresponding digital signal and a binary information transmission section for transmitting the digital signal in the form of a superimposed signal upon the level signal, the level signal and the digital signal being transmitted in a time-division multiplexing manner over the transmission line.

The receiver includes first means which is responsive to the level-shifting of the level signal for determining fire presence, and includes second means which is responsive to the digital signal transmitted from the analog-digital converter for determining fire presence based thereon independently of the first means. Thus, the binary information transmission section is cooperative with the second means of the receiver to constitute a digital signal transmission network as a main fire detection scheme, while the level-signal output section is cooperative with the first means of the receiver to constitute a level signal transmission network as a back-up fire detection scheme.

An improved feature of the present invention resides in that the fire detecting terminal means includes comparator means which is connected to the level-shifting or switching means and has its own threshold level with which the value of the analog value from the sensor is compared so that it actuates the switching means to make the shifting of the level signal when that analog value is higher than the threshold level, and that the threshold level is selected independently of a criterion utilized in determining fire presence by the main fire detection scheme or digital signal transmission network which handles the superimposed signal including the digital information of the sensed parameter.

With this provision that the level signal transmission network has its own threshold level for determination of fire presence independently of the criterion for determination of fire presence by the digital signal transmission network, the threshold level can be in such a value that the level signal transmission network is allowed to have a like sensitivity against possible fires as the digital signal transmission network. This makes it possible to constantly actuate both the main and back-up schemes and ensures that the back-up scheme can successfully determine fire presence in case of the failure of the main fire detection scheme even at the like sensitivity, presenting a true back-up fire detection retaining the same sensitivity as the main fire detection.

Accordingly, it is a primary object of the present invention to provide an improved fire alarm system which is supported by a reliable back-up fire detection, ensuring a reliable fire detection even by the back-up operation and for maintaining fire damage at a minimum.

In a preferred embodiment of the present invention, fire detecting terminal means is provided with remote testing means which is responsive to the instruction from the receiver for providing an output representative of actual fire presence so as to actuate the level-shifting or switching means, and means for transmitting a binary indication of whether or not the level-shifting means is actuated as a superimposed signal together with the digital signal to the receiver, whereby the receiver can check the operation of the level-shifting means in response to that output. With this result, the receiver can regularly test the operation of the level signal transmission network or back-up fire detection scheme and recognize the test result by utilization of the digital signal transmission network in the same manner as analyzing the digital signal. Thus, the level signal transmission network can be monitored its operation at any time such that the network can be promptly fixed if failed to respond to the test instruction, maintaining the back-up scheme reliable for fire detection in case of failure of the digital signal transmission network.

It is therefore another object of the present invention to provide a fire alarm system which is capable of checking the back-up fire detection or level signal transmission network for maintaining the system highly reliable.

In another version, the present invention provide a further improved fire alarm system which is characterized in that the level-signal output section includes supervising means for checking the operation of the digital signal transmission network and actuating the level-shifting or switching means only when the supervising means sees that the digital signal transmission network is out of operation. With this methodology, the level signal transmission network can be set to have a sensitivity against possible fires independently of the sensitivity of the digital signal transmission network, and consequently can have the same or even higher sensitivity than the latter network without causing possible interference between the two different fire detecting schemes, yet permitting the back-up scheme to detect fire presence without reduction in the sensitivity.

It is therefore a further object of the present invention to provide a fire alarm system which has a back-up fire detection scheme capable of responding to the failure of the main fire detection or digital signal transmission network to become operative so to detect fire presence instead of the main fire detection scheme and without reduction in the sensitivity.

In this version, the fire detecting terminal means is also provided with remote testing means which is responsive to the instruction from the receiver for providing such an output representative of actual fire presence as to actuate the level-shifting means to provide the level-shifted signal, at which occurrence a binary indication of whether or not the level-shifting means is actuated is transmitted to the receiver as a superimposed signal together with the digital signal, whereby the receiver can check the operation of the level-shifting means in response to that output. Thus, the back-up circuit can be regularly checked its operation so that it can operate properly in case the main fire detection or digital signal transmission network should fails.

It is therefore a still further object of the present invention to provide a fire alarm system of which back-up fire detection can be regularly checked so as to maintain the system highly reliable.

The above supervising means is designed to determine that the digital signal transmission network is out of operation when the binary information transmission section neither receives nor transmits the signal from and to the receiver over a predetermined time period. Thus, the supervising means can check the overall digital transmission network extending from the individual fire detecting terminal means to the receiver, effecting a reliable checking of the digital signal transmission network, which is a further object of the present invention.

These and still other objects of the present invention will be more apparent in the following detailed description of the preferred embodiment when taken in conjunction with the attached drawings.

DETAILED DESCRIPTION OF THE PREFERRED EMBODIMENTS

Figure 1:
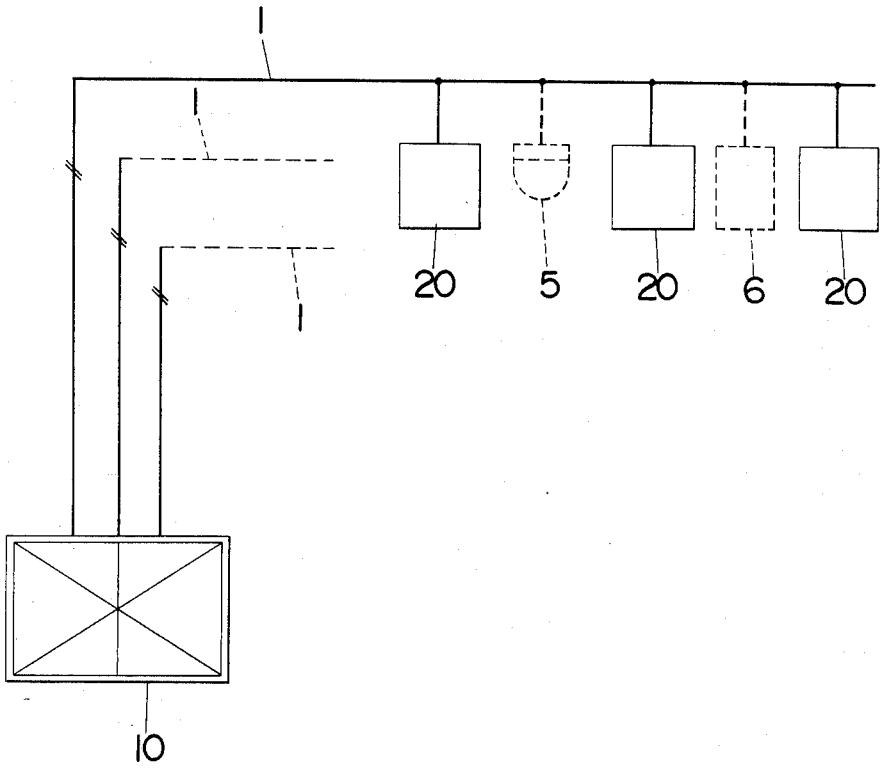
FIG. 1 is a schematic diagram of a fire alarm system embodying the present invention.

Referring now to FIG. 1, there is illustrated a fire alarm system embodying the present invention. The system comprises a receiver 10 and sets of smoke detectors 20 of composite type as fire detecting terminal means which are connected to the receiver 10 through individual signal transmission lines 1 each comprising two wires.

The system includes a digital signal transmission network as a main fire detecting scheme and a level signal transmission network as a back-up fire detection scheme, both networks sharing the common signal transmission line 1. For this purpose, each of the smoke detectors 20 is designed to be of composite type which operates on two different modes, one being a conventional contact-closure mode of transmitting to the receiver 10 a level signal indicating whether or not a significantly higher smoke density is detected, and the other being intelligent mode of transmitting a digital signal indicative of the sensed smoke density in the form of a superimposed signal upon the level signal. Thus, the former operating mode constitutes the above level signal transmission network while the latter constitutes the above digital signal transmission network.

Figure 2:
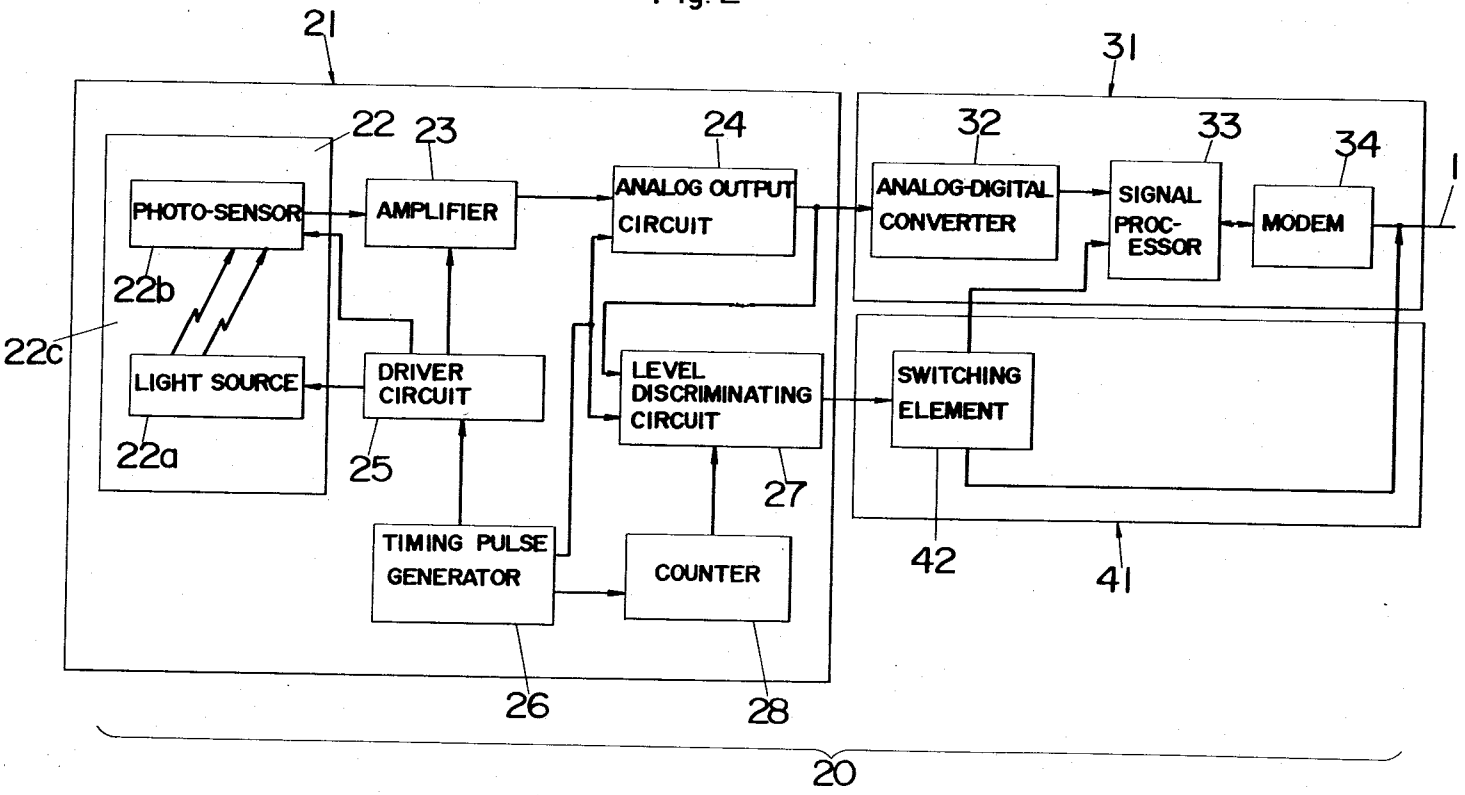
FIG. 2 is a schematic block diagram showing the functions of a smoke detector of composite type employed in the above system.

As shown in FIG. 2, each smoke detector 20 includes on one hand a level-signal output section 41 including a switching element 42 which shorts the wires of the signal transmission line 1 through a suitable impedance to transmit a contact-closure or level-shifted signal when the sensed smoke density is above a critical level and such higher smoke density lasts over a predetermined time period, and includes on the other hand a signal processor section 31 which is made of a suitable CPU and is responsible for the intelligent function of transmitting the digital signal indicative of the sensed smoke density in response to the instruction from the receiver 10 for precise and convenient analysis of the sensed data in determination of fire presence on the side of the receiver 10 in combination with other parameters such as a time period.

The level signal and the digital signal are transmitted in a time-division multiplexing manner over the transmission line 1 under the control of the receiver 10. Other types of smoke detectors 5 and 6 may be additionally attached to each line 1 for connection with the receiver 10. In the illustrated embodiment of FIG. 1, the smoke detector 5 is of conventional contact-closure type and the smoke detector 6 is of intelligent type transmitting only the digital signal to the receiver 10. It is to be noted that each of the smoke detectors 20, 5 and 6 derives its power from the receiver 10 through the corresponding data transmission line 1.

Figure 4:
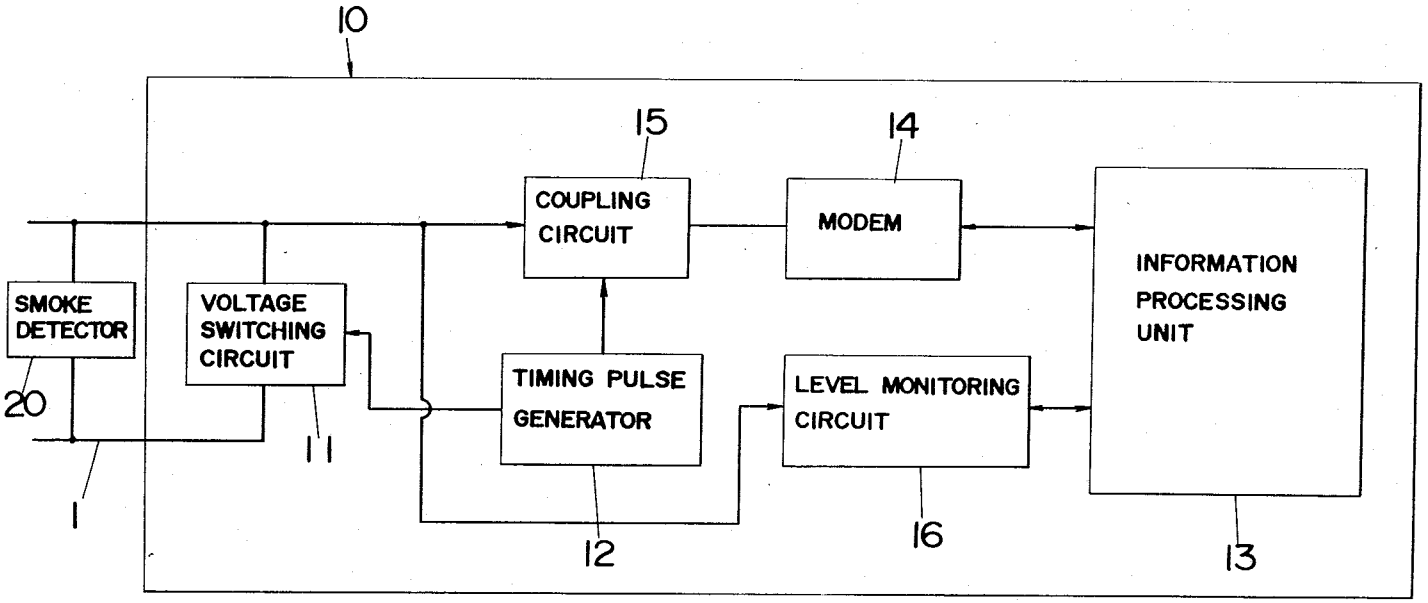
FIG. 4 is a schematic diagram showing the function of a receiver employed in the above system.
Figure 5:
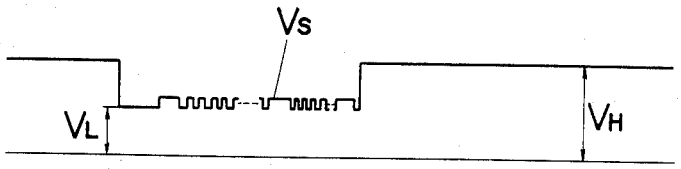
FIG. 5 is a chart illustrating waveforms carried on a signal transmission line between the receiver and the smoke detectors in the above system.

Now referring to FIG. 4, only one signal transmission line 1 is shown to be connected to the receiver 10 for easy understanding of the present system, although the receiver 10 is connected to more than one signal transmission line 1 as providing line voltages in the waveforms as shown in FIG. 5 for respective signal transmission lines 1 each carrying the one or more smoke detectors.

The receiver 10 includes time division multiplex means for determining a level signal transmission band in which the receiver 10 receives the level signal on the signal transmission line 1 and a superimposed signal transmission time band in which the receiver 10 transmit and receives the superimposed signal on the signal transmission line 1. To this end, a voltage switching circuit 11 is included in the receiver 10 for cyclically applying to the signal transmission line 1 a high voltage $V_H$ during the level signal transmission time band and a low voltage $V_L$ during the superimposed signal transmission time band under the control of a timing pulse generator 12.

An information processing unit 13 is included in the receiver 10 to prepare sets of instruction signals $V_S$ which are to be transmitted to the smoke detectors 20 and which require the individual smoke detectors 20 to send back respective reply signals indicative of sensed smoke density with respect to the individual smoke detectors 20. The information processing unit 13 also operates to process the data sent back from each of the smoke detectors 20 and 6 for determination of fire presence at the location where each of the smoke detectors 20 and 6 are installed, so as to produce an alarm signal in the form of audible or visible alarms in the order of significance depending upon the determined results, and to control other functions of the receiver 10. A modem 14 in the receiver 10 modulates and transmits the sets of instruction signals $V_S$ to the respective smoke detectors 20 and 6 through a coupling circuit 15 as well as to demodulate the reply signals sent back from the individual smoke detectors 20 and 6 through the coupling circuit 15 under the control of the information processing unit 13. The coupling circuit 15 is for transmitting the instruction signals $V_S$ as superimposed upon the level signal in synchronism with the voltage switching circuit 11 by the help of the timing pulse generator 12.

Also included in the receiver 10 is a level monitoring circuit 16 which is operative in response to the higher voltage $V_H$ being applied to the signal transmission line 1 to compare the line voltage with a predetermined voltage level, or compare the line current with a predetermined current level so as to produce an output when the line voltage falls below the predetermined voltage level, or when the line current is higher than the predetermined current level. At this occurrence, the output which is indicative of fire presence being detected is fed to the information processing unit 13 where it is subjected to necessary processing such as for issuing an alarm signal in the form of an audible or visible alarm independently of the above digital signal transmission network.

Figure 6:
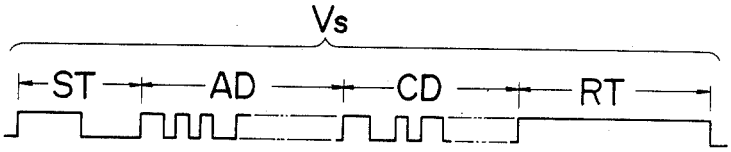
FIG. 6 is an enlarged waveform chart illustrating the details of FIG. 5.

As best shown in FIG. 6, each set of the instruction signals $V_S$ superimposed on the level signal in the signal transmission band is composed of a start signal ST, an address signal AD and a control signal CD accompanying a reply waiting duration RT during which the corresponding smoke detector 20 responds to the control signal CD for transmitting the reply signal to the receiver 10. The start signal ST, address signal AD, control signal CD and reply signal being arranged as time divided in series.

The reply signal in the form of a digital signal indicative of the sensed smoke density is processed in the information processing unit 13 for precise and convenient analysis thereof. For example, the smoke density known from the digital signal is related with a time period for presenting reliable determination of fire presence. That is, the information processing unit 13 can identify the fire presence when the smoke density exceeds a reference density level and at the same time when such smoke density lasts over a reference time period. By the nature of a micro processor utilized as the information processing unit 13, it is readily possible to set more than one reference density level or reference time period for achieving more delicate determination of fire presence in several discrete degrees of fire recognition by better utilization of the digital signal transmitted from the smoke detector 20. Such sensitivity against possible fires can be adjusted on the side of the receiver 10 with respect to each of the smoke detectors 20 to be located in different environment conditions.

As shown in FIG. 2, each of the above smoke detectors 20 of composite type comprises a smoke sensing section 21, the signal processing section 31 responsible for the intelligent operation, and the level-signal output section 41 including the switching element 42. Included in the smoke sensing section 21 is a combination light source **22*a* and photo-sensor 22*b* which define the smoke detector 20 to be of photoelectric detection type and are disposed within a sensing head 22 defining therein a smoke chamber 22***c* or light diffusion area in which smoke particles are allowed to enter for detection of smoke density. The light from the light source 22*a* is diffused or reflected from the smoke particles present in the smoke chamber 22*c* so as be received in the photo-sensor 22*b* which responds to produce an output representative of the amount of smoke particles or smoke density. The output from the photo-sensor 22*b* is fed through an amplifier 23 to an analog output circuit 24 where the amplified analog output representative of the sensed parameter or smoke density is processed necessary compensations such as temperature compensation and is then fed to an analog-digital converter 32 in the signal processing section 31. At the same time, the amplified analog output after being compensated is fed to a level discriminating circuit 27, the detail of which will be discussed hereinafter. A driver circuit 25 is cooperative with a timing pulse generator 26 to synchronize the operations of the light source 22*a*, photo sensor 22*b* and amplifier 23.

The level discriminating circuit 27 in the smoke sensing section 21 receives the output from the analog output circuit 24 so as to compare the analog value of that output with a predetermined threshold level and produces a trigger pulse to the switching element 42 when the level of the output is recognized to be greater than the threshold level continuously over a preselected time period, which time period is defined by a counter 28 operated on the timing pulse generator 26. The switching element 42 responds to such trigger pulse for shorting the wires of the transmission line 1 through the suitable impedance to transmit the level-shifted signal to the receiver 10. Upon this occurrence, the receiver 10 acknowledges fire presence independently of the operation of the digital signal transmission network, thus successfully effecting the back-up fire detection in case of the failure of the above digital signal transmission network. This is a safeguard against a possible failure of the digital signal transmission network which includes more complicated and delicate electronic components like the CPU for the intelligent operation and therefore more likely to suffer from unexpected failure than the level signal transmission network utilizing rather simple components.

Since the switching element 42 is actuated by the level discriminating circuit 27 which has its own reference with which the incoming analog data is compared, the level signal transmission network including the switch element 42 can have a sensitivity against possible fires independently of the digital signal transmission network. In other words, the level signal transmission network can have equal or even higher sensitivity than the digital signal transmission network, so that even if the digital signal transmission network should fail to operate, the level signal transmission network will take over as the back-up fire detection without reduction in sensitivity. It is to be noted at this point that the level discriminating circuit 27 receives the sensed smoke density data from the analog output circuit 24 and not from the analog-digital converter 32, which enables the construction of the level signal transmission network to be made as simple as possible, thus increasing the reliability thereof, i.e., rendering the level signal transmission network to be free from being affected by the failure of the analog-digital converter 32.

In the present embodiment, the level-signal output section 41 or switching element 42 is constantly active while the signal processor 33 is functioning to transmit and receive the digital signal to and from the receiver 10 so that the receiver 10 can detect fire presence through the above two different modes of fire detection schemes.

Figure 7:
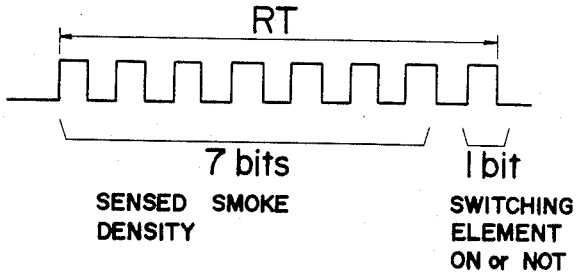
FIG. 7 is a further enlarge waveform chart illustrating the details of FIG. 6.

On the side of the signal processing section 31, the analog-digital converter 32 receives the output from the analog output circuit 24 to provide the digital signal indicating the smoke density in several discrete levels. The digital signal is then fed to the signal processor 33 from which it is transmitted to the receiver 10 through a modem 34 and the signal transmission line 1 each time the receiver 10 call for the smoke detector 20. The modem 34 demodulates the instruction signals VS transmitted from the receiver 10 during the lower line voltage $V_L$ is applied to the transmission line 1 as well as modulates and transmits the reply signal to the receiver 10. The signal processor 33, receives the demodulated instruction signals VS and performs the functions of reading the control signal CD thereof when the accompanied address signal AD is coincident with a specific address assigned to the individual smoke détector 20, providing a suitable bit number, for example as shown in FIG. 7, seven bits of serial pulse data from the output of the analog-digital converter 32 in accordance with the control signal CD, appending to the seven bits of pulse data a single bit indicative of whether or not the switching element 42 is actuated to provide the level-shifted signal, and transmitting to the receiver 10 the resulting eight bits of serial pulse date as the reply signal to the receiver 10 during the time period of receiving the reply waiting period RT accompanied by the instruction signal VS.

Figure 3:
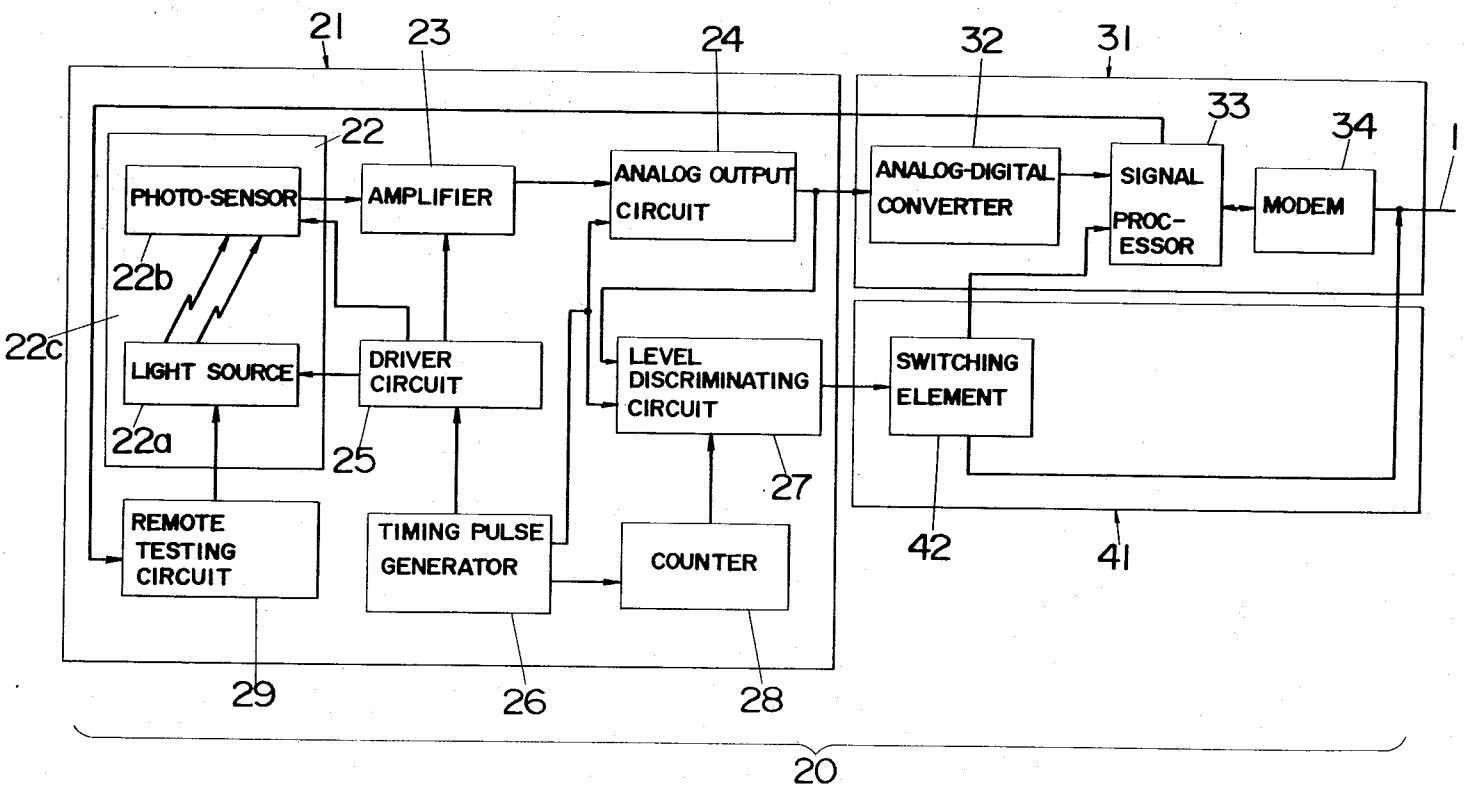
FIG. 3 is a schematic block diagram showing the functions of a modified smoke detector of composite type employed in the above system.

As shown in FIG. 3, a remote testing circuit 29 is additionally incorporated in the smoke sensing section 21 for testing the operation of said photoelectric system in response to the instruction from the receiver 10. When the remote testing circuit 29 receives the instruction from the receiver 10 through the signal processor 33 in the signal processing section 31, it causes the light source 22*a* to emit such an intensive light that the photo-sensor 22*b* can receive the light at a higher level enough to indicate the considerable amount of smoke particles being present, whereby the smoke detector 20 presents and transmits the smoke density signal indicating the significant smoke density to the receiver 1 for checking the operation of the system. This is advantageous not only for checking the operation of the digital transmission network but also for checking the operation of the level signal transmission network, or back-up fire detection, since the receiver 10 can monitor and check at any time whether or not the back-up fire detection can operate properly by examining the last bit of the eight bits of the above pulse data transmitted to the receiver 10 through the digital signal transmission network. Accordingly, the present fire alarm system can regularly test the back-up fire detection itself so as to permit the restoring thereof if it is found to be in error before there should arise serious fires, eliminating the possibility of the back-up scheme failing to work properly or support the main fire detecting scheme. In fact, the back-up operation with increased reliability is mostly desired for the fire alarm system which is not permitted to miss the fire detection under any circumstances.

Figure 8:
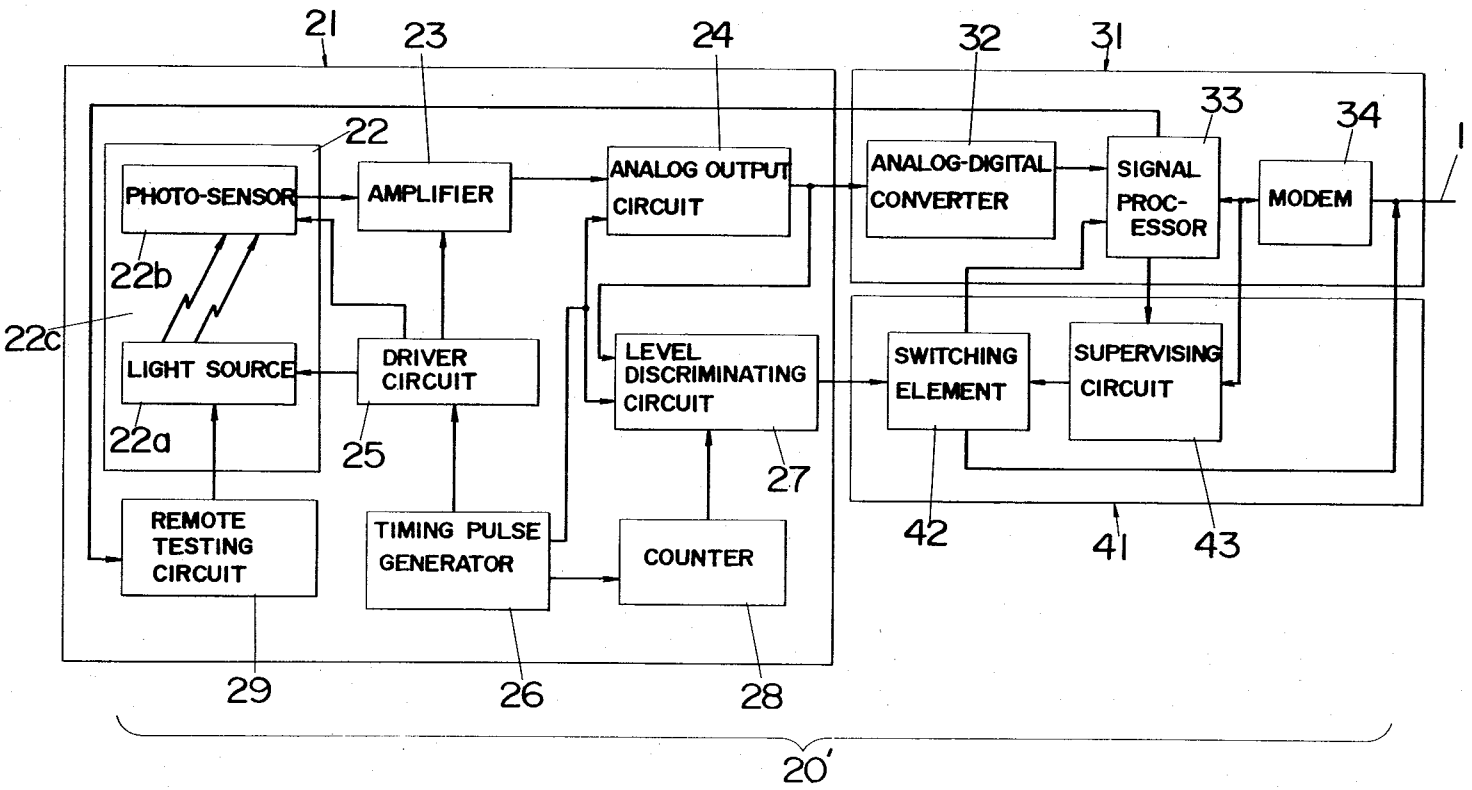
FIG. 8 is a schematic block diagram showing the function of a smoke detector of composite type employed in a fire alarm system in accordance with another embodiment of the present invention.

In a second preferred embodiment of the present invention, the fire alarm system utilizes a modified smoke detector 20' which, as shown in FIG. 8, is identical in construction except that it includes a supervising circuit 43. The other construction and operation are similar to the smoke detector 20 of the previous embodiment and therefore like numerals are employed to designate like parts as in the smoke detector 20 of the previous embodiment.

Figure 9:
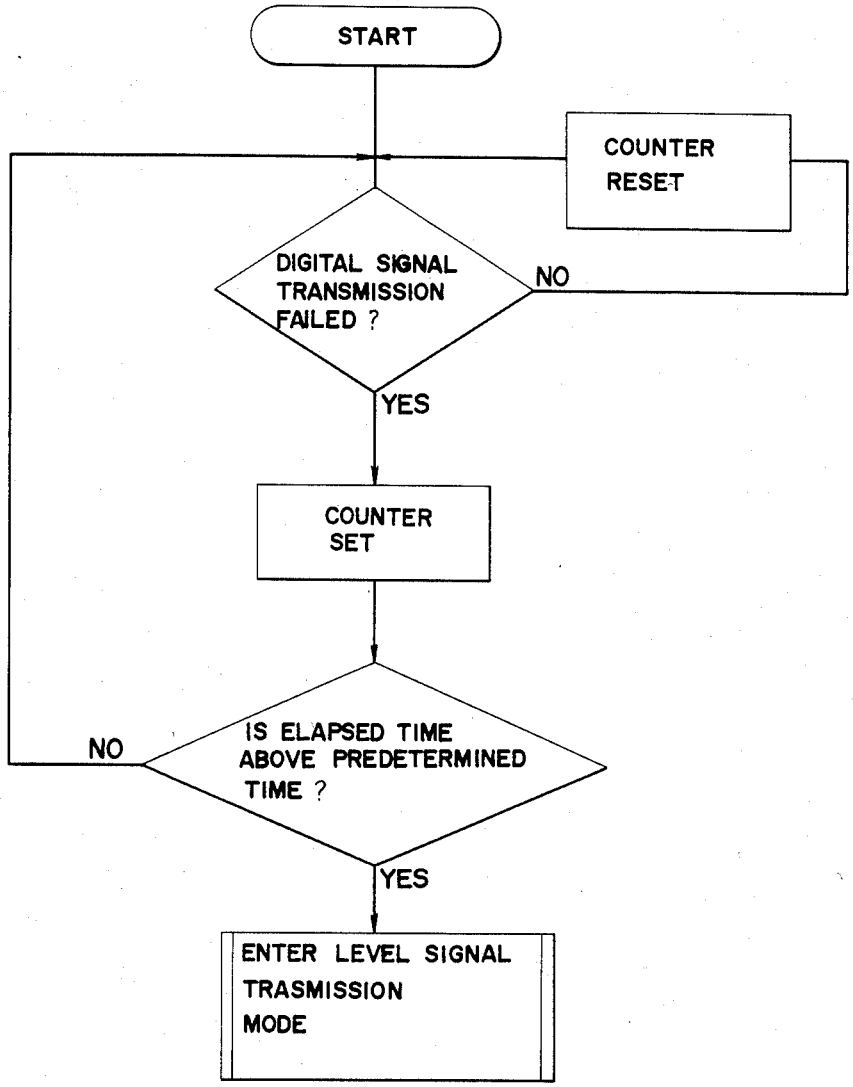
FIG. 9 is a flow diagram illustrating the operational sequence of the above system.

The supervising circuit 43 is incorporated for constantly checking the operation of the digital signal transmission network and setting the switching element 42 active only when the supervising circuit 43 sees that the digital transmission network is out of operation so as to automatically turn the system into the back-up fire detection mode of detecting fire presence by the level signal transmission network, while on the side of the receiver 10 the level monitoring circuit 16 remains constantly active. With the provision of the supervising circuit 43, the receiver 10 is enough to acknowledge the fire indicative data through one of the two different modes of fire detections at a time, thus rendering the interpretation of that data rather easy. The supervising circuit 43 is designed to determine that the digital signal transmission network is out of operation when the smoke detector 20' neither receives nor transmits the signal from and to the receiver 10 over a predetermined time period. That is, as illustrated in the flow diagram of FIG. 9, the supervising circuit 43 constantly sees at a first step whether the digital signal transmission fails to operate. A counter in the supervising circuit 43 is then set to start measuring the elapsed time if the failure is found, otherwise the counter is reset. When the counter is set, the sequence proceeds to a next step where the elapse time is examined whether it is greater than a predetermined reference time period. If yes, the monitoring means acknowledge the failure of the digital signal transmission network and sets the switching element 42 active so as to be ready for the back-up fire detection mode. If not, the sequence is returned back to the first step.

The smoke detector 20' also incorporates like remote testing circuit as utilized in the previous embodiment which is in response to the instruction from the receiver 10 for checking the operations of the digital transmission network as well as the level signal transmission network. In this connection, the supervising circuit 43 responds to such remote testing instruction for setting the switching element 42 in operation regardless of the status of the digital signal transmission network, enabling to successfully check the operation of the back-up fire detection by appending to the seven bits of the pulse data a single bit of data indicative of whether or not the switching element 42 responds to provide a level-shifted signal, as in the same manner described in the previous embodiment.

In the present embodiment, the smoke detectors 20 and 20' utilize the sensing head 22 of photoelectric type, however, ion sensing heads incorporating an ionization chamber may be utilized instead. Also, other types of detectors such as flame detectors of ultraviolet or infrared light sensing type may be utilized as the fire detecting terminal means in stead of the smoke detectors 20 and 20'. Further, in the present embodiments, the digital signal and the level signal are transmitted in synchronism with the switching of the line voltage between the high voltage level $V_H$ and the low voltage level $V_L$, these signal can be transmitted without switching the line voltage.

Although, the smoke detectors 20 and 20' of the above embodiment are arranged to have the single signal processing section 31 for each smoke sensing section 21 and level-signal output section 41, the present invention is not understood to be limited to this configuration but to include a terminal arrangement in which the signal processing section 31 is utilized as a repeater to be connected to a plurality sets of the smoke sensing sections 21 and the level-signal output sections 41. In this connection, the present invention can be of course extended to a multi-branch system in which a plurality of the receivers 10 each having several signal transmission lines 1 carrying the several sets of the smoke detectors are connected together to a central monitoring station for intercommunication therebetween in a time-division multiplexing manner. Further, the receiver 10 can be interlocked with conventional fire prevention equipments such as fire shutters, smoke ejectors or the like for effectively operating the same based upon the determination of fire presence by the receiver 10.

What is claimed is:

1. In a fire alarm system comprising a receiver in combination with fire detecting terminal means connected thereto through a common signal transmission line comprising two wires, said fire detecting terminal means including:

a sensor for sensing a fire-indicative parameter such as a smoke density to be measured and producing an analog signal representative thereof;

a level-signal output section for transmitting a level signal to the receiver, said level-signal output section including level-shifting means connected between the wires of the transmission line so as to cause the level-shifting of the level signal when the sensed parameter has a level higher than a predetermined threshold level;

an analog-digital converter converting the analog signal from the sensor into a corresponding digital signal;

a binary information transmission section for transmitting the digital signal in the form of a superimposed signal upon the level signal, the level signal and the digital signal being transmitted in a time-division multiplexing manner over the transmission line; and said receiver including:

first means responsive to the level-shifting of the level signal for determining fire presence;

second means responsive to the digital signal transmitted from the analog-digital converter for determining fire presence based thereon independently of the first means;

the improvement comprising:

said fire detecting terminal means including: comparator means connected to the level-shifting means, said comparator means has the threshold level with which the value of the analog signal from the sensor is compared so that it actuates the level-shifting means to make the shifting of the level signal when the analog signal has a level higher than the threshold level, and said threshold level being selected independently of a criterion utilized in determining fire presence by the second means receiving the superimposed signal including the information of the sensed parameter.

2. A fire alarm system as set forth in claim 1, wherein said binary information transmission section transmits to the receiver the superimposed signal including the information of the level signal together with the sensed parameter.

3. A fire alarm system as set forth in claim 1, wherein the fire detecting terminal means is provided with remote testing means responsive to the instruction from the receiver for providing such an output representative of fire presence as to actuate the level-shifting means, and means for transmitting a binary indication of whether or not the level-shifting means is actuated as a superimposed signal together with the digital signal to the receiver, whereby the receiver can check the operation of the level-shifting means in response to that output.

4. In a fire alarm system comprising a receiver in combination with fire detecting terminal means connected thereto through a common signal transmission line comprising two wires, said fire detecting terminal means including:

a sensor for sensing a fire-indicative parameter such as a smoke density to be measured and producing an analog signal representative thereof;

a level-signal output section for transmitting a level signal to the receiver, said level-signal output section including level-shifting means connected between the wires of the transmission line so as to cause the shifting of the level signal when the sensed parameter has a level higher than a predetermined threshold level;

an analog-digital converter converting the analog signal from the sensor into a corresponding digital signal;

an binary information transmission section for transmitting the digital signal in the form of a superimposed signal upon the level signal, the level signal and the digital signal being transmitted in a time-division multiplexing manner over the transmission line; and said receiver including:

first means responsive to the shifting of the level signal for determining fire presence;

second means responsive to the digital signal transmitted from the analog-digital converter for determining fire presence based thereon independently of the first means;

the improvement comprising:

said fire detecting terminal means including: comparator means connected to the level-shifting means, said comparator means has the threshold level with which the value of the analog signal from the sensor is compared so that it actuates the level-shifting means to make the shifting of the level signal when the analog signal has a level higher than the threshold level, and said threshold level being selected independently of a criterion utilized in determining fire presence by the second means receiving the superimposed signal including the information of the sensed parameter; and said level-signal output section including supervising means for checking the operation of the digital signal transmission and for actuating the level-shifting means only when the supervising means sees that the digital signal transmission is is out of operation.

5. A fire alarm system as set forth in claim 4, wherein the fire detecting terminal means is provided with remote testing means responsive to the instruction from the receiver for providing such an output representative of fire presence to actuate said level-shifting means, and means for transmitting a binary indication of whether or not the level-shifting means is actuated as a superimposed signal together with the digital signal to the receiver, whereby the receiver can check the operation of the level-shifting means in response to that output.

6. A fire alarm system as set forth in claim 4, wherein said supervising means determines that the digital signal transmission is out of operation when the binary information transmission section neither receives nor transmits the digital signal from and to the receiver over a predetermined time period.

7. A fire alarm system as set forth in claim 4, wherein said fire detector is a smoke detector which is sensitive to a smoke density for generating the analog data representative thereof.

8. In a fire alarm system comprising a receiver in combination with fire detecting terminal means connected thereto through a common signal transmission line comprising two wires, said fire detecting terminal means including:

a sensor for sensing a fire-indicative parameter such as a smoke density to be measured and producing an analog signal representative thereof;

a level-signal output section for transmitting a level signal to the receiver, said level-signal output section including switching means connected between the wires of the transmission line so as to be closed when the sensed parameter has a level higher than a predetermined reference level;

an analog-digital converter converting the analog signal into a corresponding digital signal;

a binary information transmission section for transmitting the digital signal in the form of a superimposed signal upon the level signal, the level signal and the digital signal being transmitted in a time-division multiplexing manner over the common signal transmission line; and said receiver including:

first means responsive to the contact-closure signal from the switching means for determining fire presence;

second means responsive to the digital signal transmitted from the analog-digital converter for determining fire presence based thereon independently of the first means;

the improvement comprising:

said fire detecting terminal means including: comparator means connected to the level-shifting means, said comparator means has the threshold level with which the value of the analog signal from the sensor is compared so that it actuates the level-shifting means to make the shifting of the level signal when the analog signal has a level higher than the threshold level, and said threshold level being selected independently of a criterion utilized in determining fire presence by the second means receiving the superimposed signal including the information of the sensed parameter; and said level-signal output section including supervising means for checking the operation of the digital signal transmission and for actuating the switching means only when the supervising means sees that the digital signal transmission is out of operation.

9. A fire alarm system as set forth in claim 8, wherein the fire detecting terminal means is provided with remote testing means responsive to the instruction from the receiver for providing such an output representative of the fire presence as to actuate said switching means, and means for transmitting a binary indication of whether or not the switching means is actuated as a superimposed signal together with the digital signal to the receiver, whereby the receiver can check the operation of the switching means in response to that output.

10. A fire alarm system as set forth in claim 8, wherein said supervising means determines that the digital signal transmission is out of operation when the binary information transmission section neither receives nor transmits the signal from and to the receiver over a predetermined time period.

11. A fire alarm system as set forth in claim 8, wherein said fire detector is a smoke detector which is sensitive to a smoke density for generating the analog data representative thereof.

* * * * *